United States Patent [19]

Molina

[11] Patent Number: 4,649,732

[45] Date of Patent: Mar. 17, 1987

[54] FASTENER INSTALLATION TOOL

[75] Inventor: Jorge W. Molina, La Verne, Calif.

[73] Assignee: Deutsch Fastener Corp., Lakewood, Calif.

[21] Appl. No.: 764,610

[22] Filed: Aug. 12, 1985

[51] Int. Cl.[4] ..... B21D 31/00

[52] U.S. Cl. ..... 72/391; 72/114

[58] Field of Search ..... 72/391, 114; 29/243.52, 29/267, 509, 453.02; 411/111

[56] References Cited

U.S. PATENT DOCUMENTS

| | | | |
|---|---|---|---|
| 3,638,472 | 2/1972 | Orloff et al. | 29/243.52 |
| 3,665,581 | 5/1972 | Gulistan | 29/243.52 |
| 3,695,324 | 10/1972 | Gulistan | 411/111 |
| 3,892,121 | 7/1975 | Champoux et al. | 29/243.52 |
| 4,402,203 | 9/1983 | Molina | 72/114 |
| 4,559,691 | 12/1985 | Mannhart et al. | 72/453.02 |

*Primary Examiner*—Spruill R. L.
*Assistant Examiner*—David B. Jones
*Attorney, Agent, or Firm*—Gausewitz, Carr & Rothenberg

[57] ABSTRACT

This invention provides a tool for attaching fasteners to a workpiece that includes a slide within a body and a rod threaded into the slide. The outer end of the rod threads into the floating nut of a fastener assembly with an enlargement on the rod centering the nut and the fastener sleeve. The tool includes a die through which the rod extends. A segmented spacer fits around the die to support the workpiece around the opening through it, while the rod, pulled by the slide, draws the fastener sleeve into the opening. The segments of the spacer then are separated and retracted, exposing the die. Further actuation forces the die against the end of the fastener sleeve to flare it outwardly and form a flange for retaining the fastener to the workpiece.

20 Claims, 13 Drawing Figures

FASTENER INSTALLATION TOOL

BACKGROUND OF THE INVENTION

Certain fasteners include a cylindrical sleeve which is fitted through an opening in a workpiece. The end of the sleeve then is flared outwardly to form a flange used in holding the fastener to the workpiece. Also included may be a rotation-resisting means, such as a straight knurl, which becomes embedded in the wall of the opening when the sleeve is fitted into the opening. This kind of fastener is exemplified by that of U.S. Pat. No. 3,695,324. Fasteners of these types are in widespread use in the aerospace industry.

It is important to have a portable, manually operable tool for installing these fasteners on panels in field service conditions. A successful tool of this nature is shown in U.S. Pat. No. 3,665,581. The tool of this patent includes a puller which is moved by a member within a body, which is actuated by a movable handle. The puller is at the axis of a die member which flares the end of the sleeve of the fastener as the fastener is pulled into the opening in the workpiece. For use with a fastener of the type of U.S. Pat. No. 3,695,324, a two-stage operation is required, first pulling the sleeve into the opening in the workpiece, causing the straight knurl on the fastener sleeve to become embedded in the wall of the opening. After that, the end of the sleeve is bent outwardly by the die surface to form a flange. In the tool of U.S. Pat. No. 3,665,581, a spacer is provided to bear against the workpiece and maintain the die away from the end of the sleeve as the sleeve is drawn into the opening. This is a rotatable member with a C-shaped end, having an opening that enables it to fit around the die member.

This construction has certain disadvantages. In particular, it is not usable for installing the fasteners in thin panels. This is because the spacers does not engage the workpiece around the perimeter of the opening through it, leaving portions of the workpiece unsupported. As a result, a thin panel will buckle as the puller draws the sleeve into the opening in the workpiece against the resistance of the knurl as it becomes embedded in the wall of the workpiece. Also, this prior tool lacks convenience in some respects. Different lengths of pullers must be installed in order to accommodate panels of different thicknesses so that the die surface will be properly located with respect tc the end of the sleeve. Replacement of the puller in this tool required disassembly of the major portion of the tool, which is a very time-consuming operation. Also, when the tool of U.S. Pat. No. 3,665,581 is used, there is no assurance that the sleeve will be properly centered with respect to the die surface. This occurs because the nut of the fastener can float relative to the basket upon which it is fitted, enabling it to move laterally to one side, out of alignment with the sleeve. Inasmuch as the puller is attached to the nut, the die of the tool then becomes misaligned with respect to the fastener sleeve. In that event, a proper flare may not be obtained, and, in some instances, the narrow tapering die surface will be broken so as to require an expensive die replacement.

SUMMARY OF THE INVENTION

The present invention provides a tool overcoming the problems of the prior art such as those noted above. The tool includes a segmented spacer constructed somewhat like a collet circumscribing the die member.

The forward edge of the segmented spacer, which engages the workpiece, extends inwardly almost to the die surface, enabling it to bear against the workpiece around the perimeter of the opening into which the fastener is drawn. It is uninterrupted around its circumference, providing full support for the workpiece so that it will not buckle or deflect even if the workpiece is of thin material. The segments of the spacer then are separated and retracted, exposing the die for the subsequent flaring of the fastener sleeve. In addition, there is a hexagonal portion on the puller which fits within the sleeve, centering the nut with respect to the sleeve and hence aligning the sleeve with the die member. This assures proper engagement of the sleeve by the die, which obviates damage to the die or an improper flare on the sleeve. This also enables the puller to be replaced without disassembly of the remaining components of the device. A simple screw adjustment is provided which controls the position of the die member relative to the puller so that the tool can be adjusted to accommodate fasteners used with workpieces of different thicknesses. Replacement of the puller for this purpose is avoided. The overall operation of the tool is extremely simple, so that its use is rapid and effective. Servicing is easier than in the designs of the prior art. For example, the die member can be replaced without disassembly of the remainder of the tool, unlike earlier designs.

DETAILED DESCRIPTION OF THE INVENTION

Figure 1:
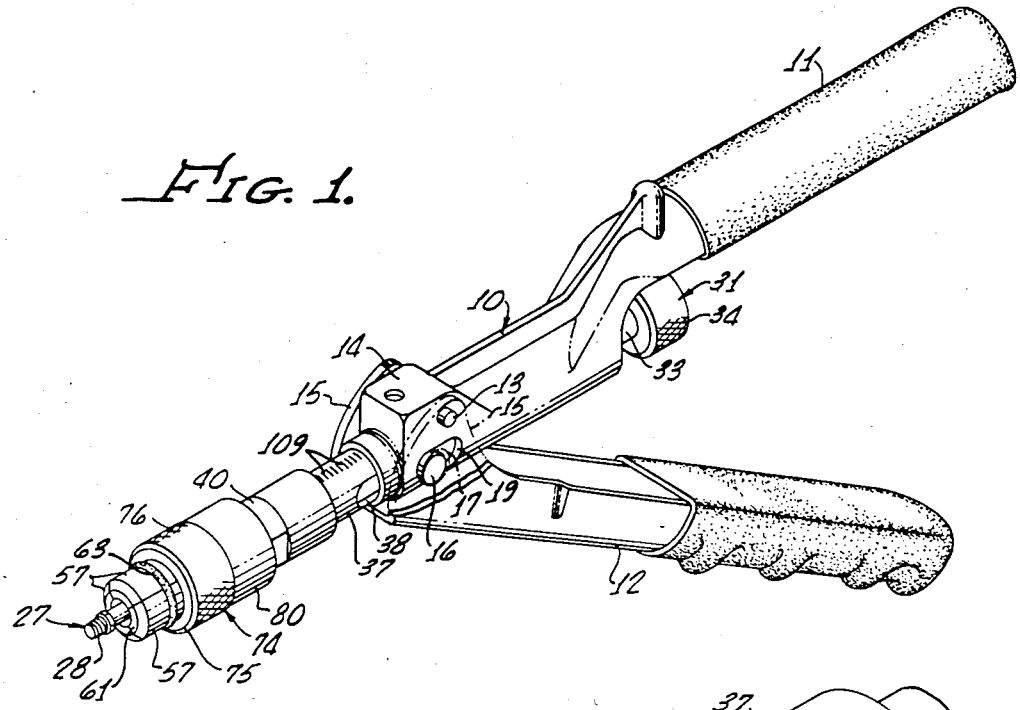
FIG. 1 is a perspective view of the tool of this invention.
Figure 2:
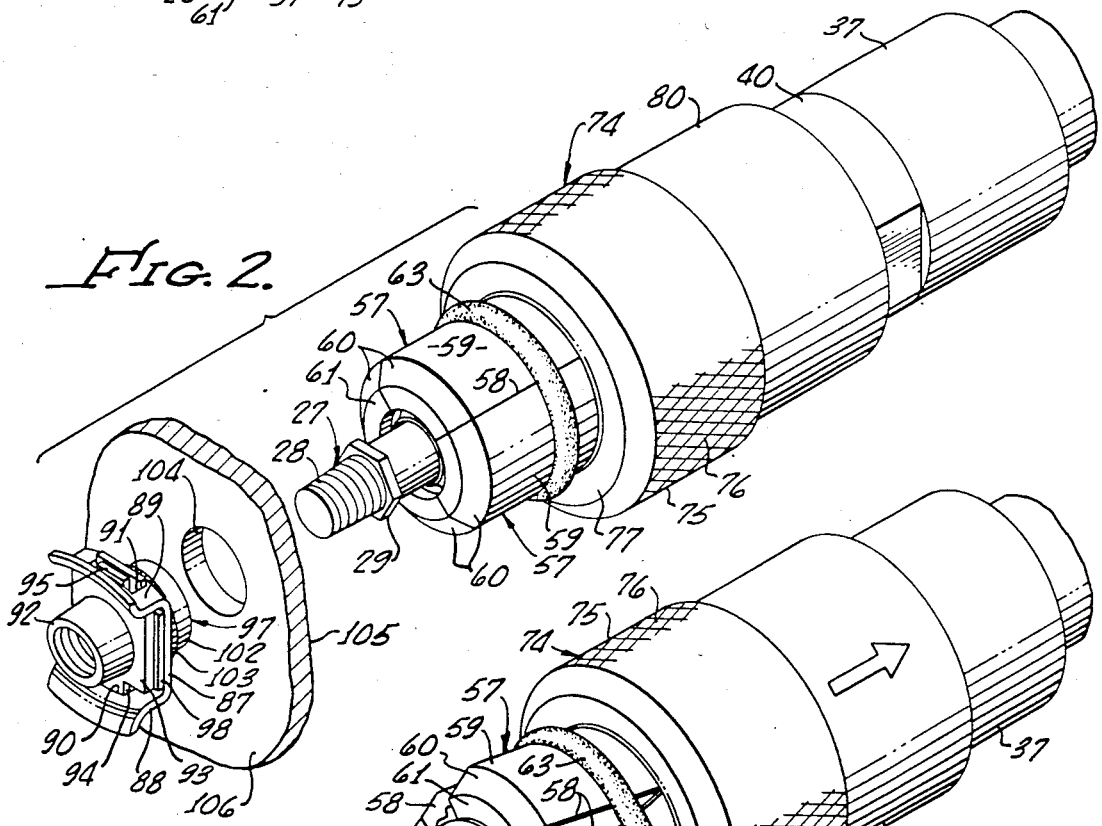
FIG. 2 is an enlarged fragmentary perspective view of the forward portion of the tool, together with a workpiece and a fastener to be installed in the workpiece.

The tool of this invention includes a tubular body 10 from the rearward end of which extends an offset handle 11. A second handle 12 is pivotally connected to the body 10 near its forward end by a transverse pivot pin 13, which passes through an offset portion 14 of the body 10 and is laterally displaced from the longitudinal axis of the body.

The handle 12 is formed as a yoke 15 that fits around the outside of the body 10 at its forward end where the connection is made to the transverse pivot pin 13. Also extending through the yoke 15 of the handle 12 is a second and larger transverse pin 16. The openings 17 in the yoke 15 for the pin 16 are larger in diameter than the pin so that there is limited relative lateral movement permitted between the handle and the pin 16.

The pin 16 passes through opposed longitudinal slots 19 in the wall of the tubular body 10. Inside the body 10 is a slide 20 through which the pin 16 also passes. A set screw 21 in an axial threaded opening 22 in the slide 20 holds the pin 16 to the slide. This means that when the handle 12 is pivoted relative to the body 10 about the pivot pin 13, the pin 16 will cause longitudinal movement of the slide 20 with respect to the body 10. Movement of the handle 12 toward the handle 11 will cause the slide 20 to move rearwardly, or to the right, as illustrated.

The forward end of the slide 20 is of reduced diameter and exteriorly threaded. This end fits within and engages threads in the rearward portion of a tubular member 24, which also is movable with respect to the body 10. At the forward end of th tubular member 24 is a threaded opening 25 which receives the threaded rearward end 26 of a rod 27. The forward end 28 of the rod 27 also is threaded and tapered toward the end. At the inner end of the thread 28 is a hexagonal section 29 which has a larger transverse dimension than the remainder of the rod 27.

Figure 4:
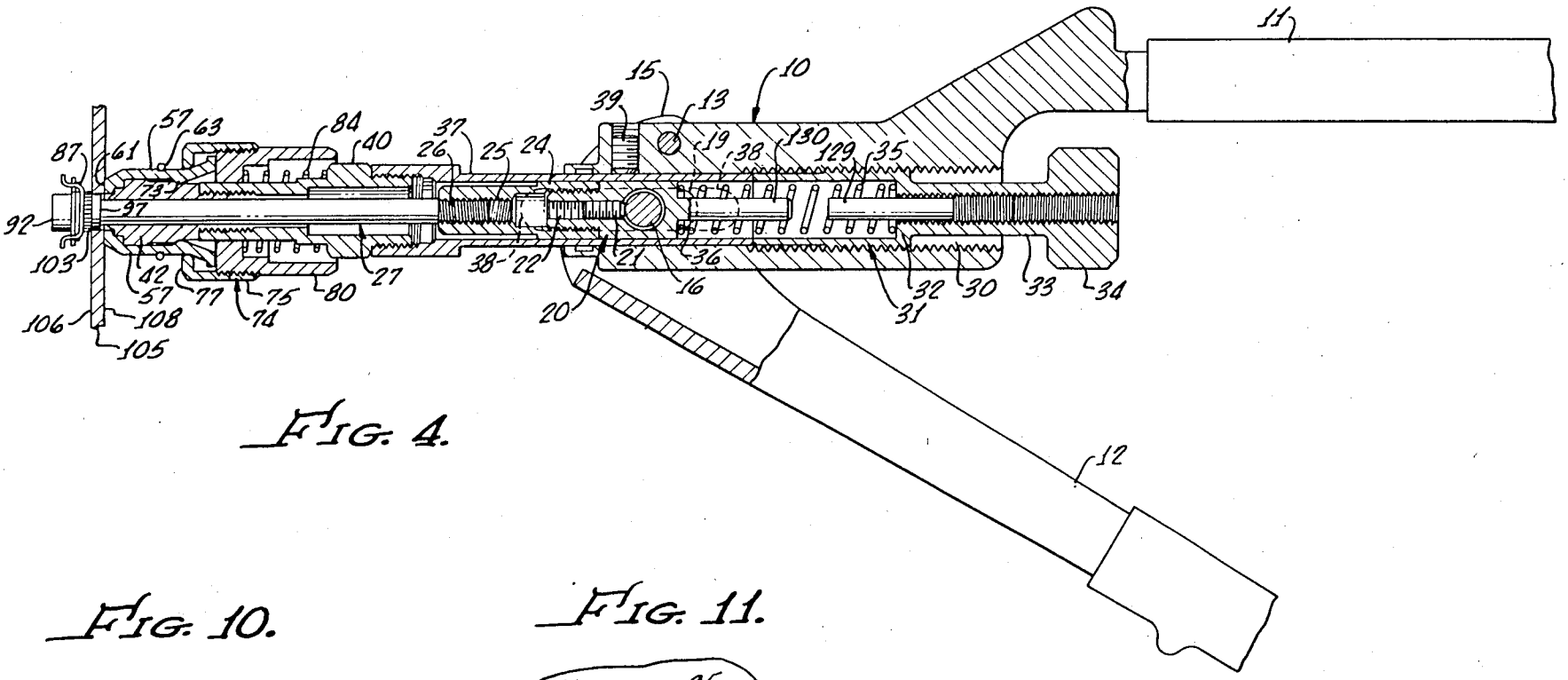
FIG. 4 is a longitudinal sectional view of the tool in its initial position for installing a fastener in a workpiece.
Figure 11:
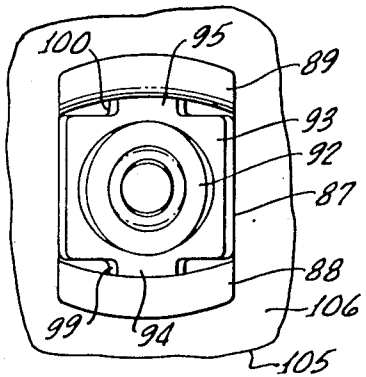
FIG. 11 is a top plan view of a fastener which is operated on by the tool of this invention.
Figure 10:
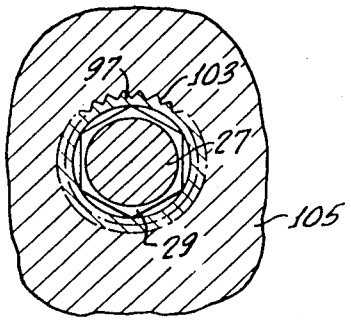
FIG. 10 is a transverse sectional view taken along line 10—10 of FIG. 8.
Figure 5:
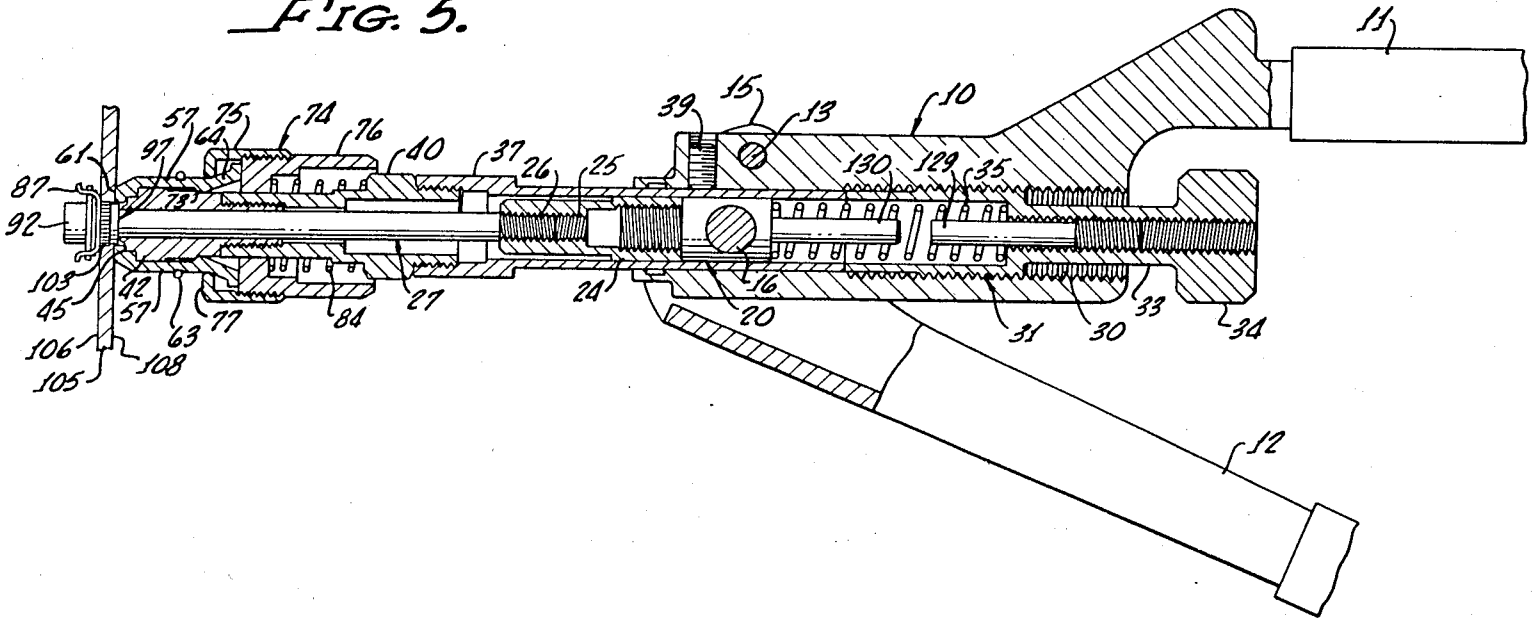
FIGS. 5 and 6 are views similar to FIG. 4, showing subsequent stages of the installation of the fastener.
Figure 6:
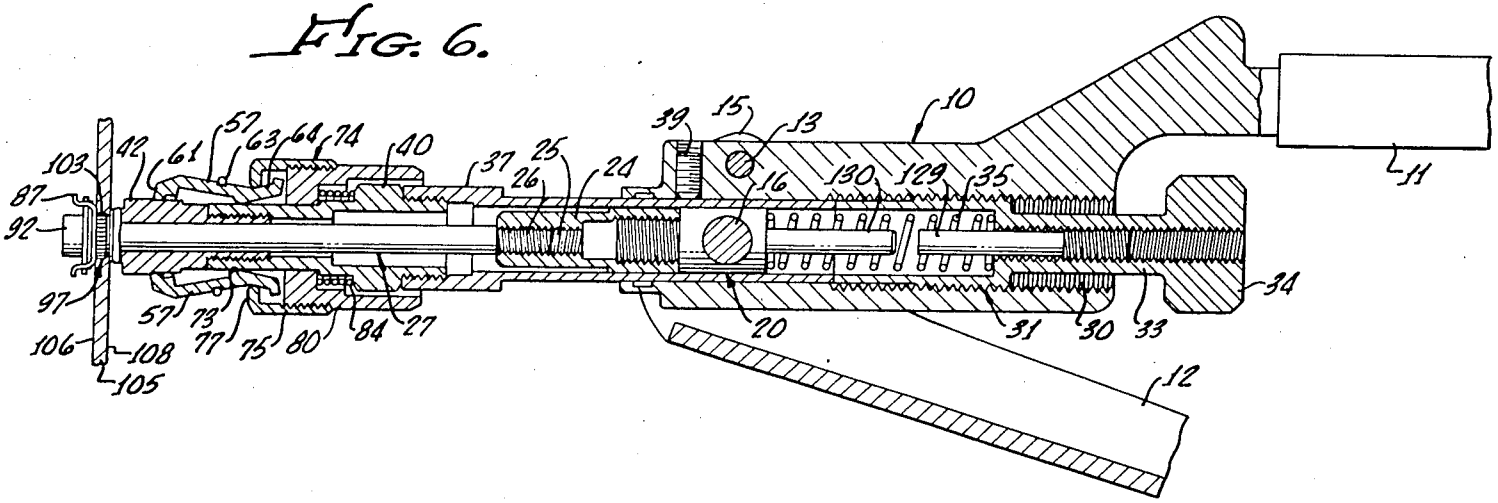

The bore of the body 10 includes a threaded portion 30 at its rearward end which receives an adjusting sleeve 31. A portion of the adjusting sleeve 31 is exteriorly threaded, meshing with the threaded portion 30 of the bore of the body 10. The adjusting sleeve 31 includes a radial internal wall 32 and an outwardly projecting axial stem 33 at the outer end of which is a knurled knob 34. The latter element is outside of the body 10. A compression spring 35 extends into the adjusting sleeve 31 at one end to engage the radial inner end wall 32 of that member. The opposite end of the spring 35 bears against the rearward face 36 of the slide 20. Hence, the spring 35 biases the slide 20 forwardly, or to the left, as illustrated. As a result of the spring force, the slide 20 moves the pin 16 to the forward ends of the slots 19 and holds the handle 12 open when the tool is at rest, as shown in FIGS. 1 and 4.

Received within the forward end of the body 10, and projecting outwardly from it, is a sleeve 37 which has opposed, elongated longitudinal slots 38 through which passes the pin 16. The outer surface of the sleeve 37 is complementary to the bore of the body 10. A set screw 39 extends inwardly through a threaded opening in the body 10 to engage the exterior of the sleeve 37 and hold it axially relative to the body, so that in effect the sleeve becomes part of the body. The slide 20 fits complementarily within the sleeve 37.

The forward end of the sleeve 37 is enlarged and internally threaded, receiving the threaded rearward end of a member 40, which also is of tubular construction. The forward end of the member 40 is internally threaded and receives the exteriorly threaded rearward end of reduced diameter of a die member 42.

A longitudinal bore 43 extends through the die member 42 and closely receives the rod 27 inwardly of the hexagonal portion 29. The forward end of the die member 42 is provided with an annular surface 44 around the bore 43, which inclines rearwardly and radially outwardly away from the axis. The inner end of the surface 44 connects to a radial surface 45 that extends outwardly from it. The surfaces 44 and 45 are used in flaring a fastener sleeve to attach the fastener to a workpiece, as will be explained below. The die has a thin forward edge 46 at the forward end of the inclined annular surface 44.

Exteriorly, the die member 42 includes a short cylindrical portion 48 that extends rearwardly from the outer edge of the radial surface 45 and connects to a radial shoulder 49. The die member 42 also is provided with a longitudinal cylindrical exterior surface 51 that extends rearwardly from the radial shoulder 49. Opposed flats 52 interrupt the surface 51 and provide wrenching surfaces for installing or removing the die member 42. An inclined annular surface 53 connects the rearward end of the surface 51 to a rearward cylindrical portion 54. A rearwardly facing radial shoulder 55 on the die member 42 bears against the forward end surface 56 of the member 40.

Around the die member 42 are four identical members 57 which collectively resemble a collet, although they are not used for gripping. When in the closed position, with their longitudinal edges 58 abutting, the members 57 provide a continuous tubular element circumscribing the die member 42, and act as a pressure pad and spacer, as described below. In this position, the members 57 present an exterior cylindrical surface 59, connection through a bevel 60 to an uninterrupted forward radial end surface 61. The latter is located close to, but forwardly and beyond, the forward edge 46 of the die surface 44.

The cylindrical surface that the closed pressure pad members 57 present includes an annular recess 62 that receives an O-ring 63 of elastomeric material. The O-ring 63 exerts an inward radial force that tends to keep the members 57 in the closed position. At the rearward end of the cylindrical surface 58, the closed members 57 provide an outwardly flaring frustoconical portion 64 that terminates at an outwardly extending flange 65 and a radial rearward end surface 66.

On the interior, the closed members 57 define a short cylindrical surface 68 at the inner end of which is a beveled surface 69 leading to a short cylindrical surface 70. At right angles to the surface 70 is a radial shoulder 71 at the outer edge of which is a longitudinal cylindrical surface 72. The surface 70 and shoulder 71 of the members 57 are of the same length and complementary to the surface 48 and shoulder 49 of the die member 42. The inner surface 72 of the members 57 overlies and is complementary to the external cylindrical surface 51 of the die member 42.

Figure 7:
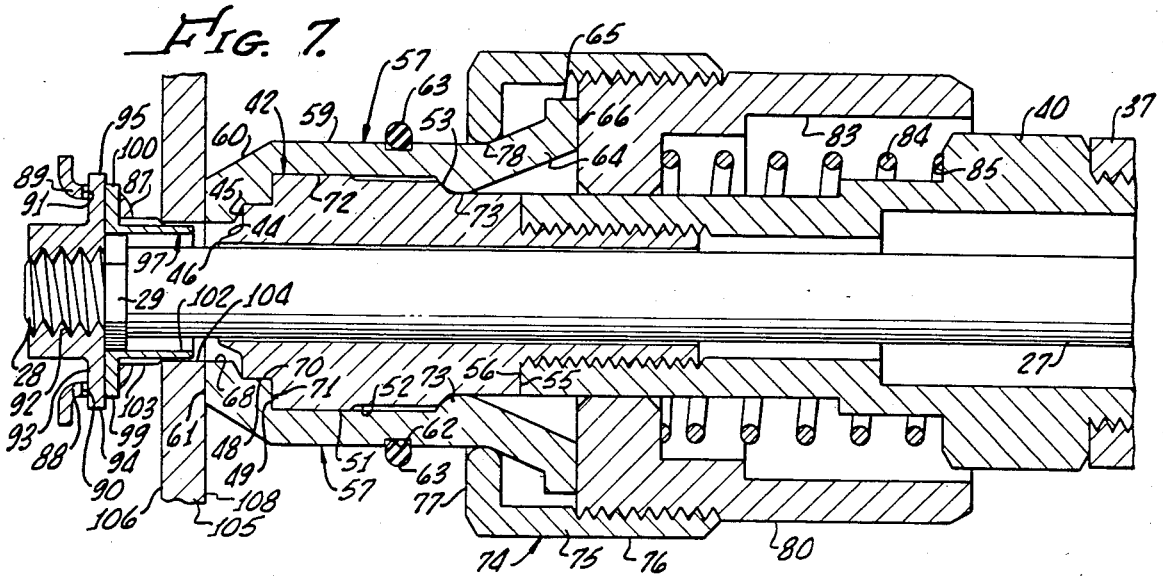
FIG. 7 is an enlarged fragmentary longitudinal sectional view of the forward portion of the tool as it is associated with a fastener to be drawn into an opening in the workpiece.
Figure 8:
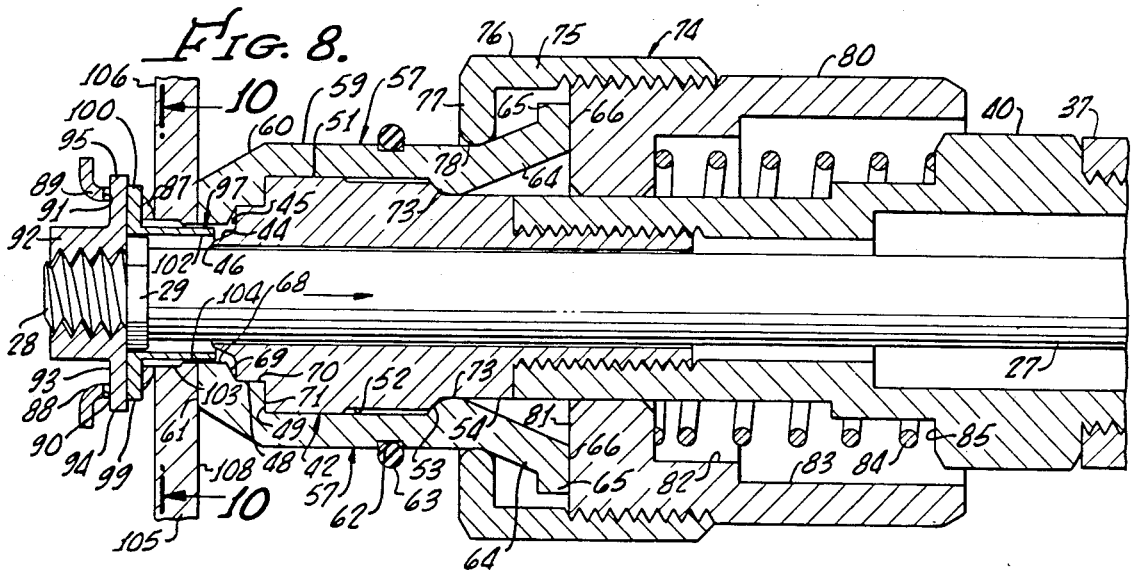
FIG. 8 is a view similar to FIG. 7, but with the tool actuated so as to draw the fastener into the opening in the workpiece.

At the rearward end of the surface 72 of the members 57 is an inwardlydirected, rounded annular surface 73 that leads to the outwardly flaring frustoconical portion 64. In the closed position of FIGS. 7 and 8, the rounded surface 73 is adjacent and bears against the external beveled edge 53 of the die member 42.

Adjacent the rearward ends of the members 57 is a collar assembly 74 that includes a short sleeve 75 which has a knurled external cylindrical surface 76 and a forward radial end wall 77. An opening extends through the radial end wall 77, being provided with a rounded edge 78. This edge fits around the members 57 and, when the latter are in their closed position, is located at the juncture between the surface 58 and the outwardly-flaring frustoconical portion 64.

The rearward end of the sleeve 75 is internally threaded and meshes with the external threads of a collar 80. A radial wall 81 is at the forward end of the collar 80 and is engaged by the rearward radial end surface 66 presented by the closed members 57. Interiorly, the collar 80 has a forward cylindrical portion 82 and a rearward cylindrical portion 83 of slightly larger diameter. A light compression spring 84 at one end bears against the rearward face of the forward radial end wall 81 of the collar 80. The other end of the spring 84 engages a forwardly-facing radial shoulder 85 formed on the exterior of the member 40. The spring 84 biases the collar assembly to its forward position shown in FIGS. 7 and 8.

Figure 3:
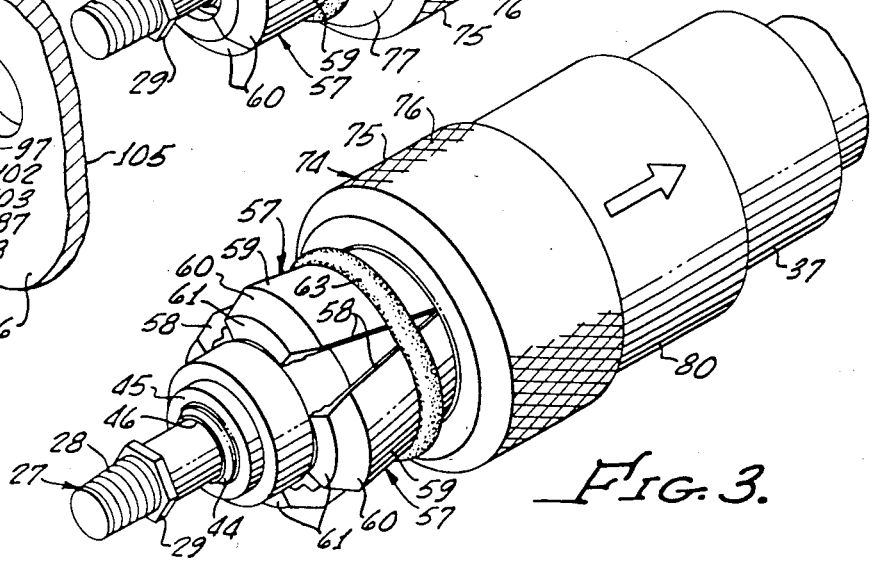
FIG. 3 is an enlarged fragmentary illustration of the forward portion of the tool, with the segmented spacer in the retracted position.
Figure 9:
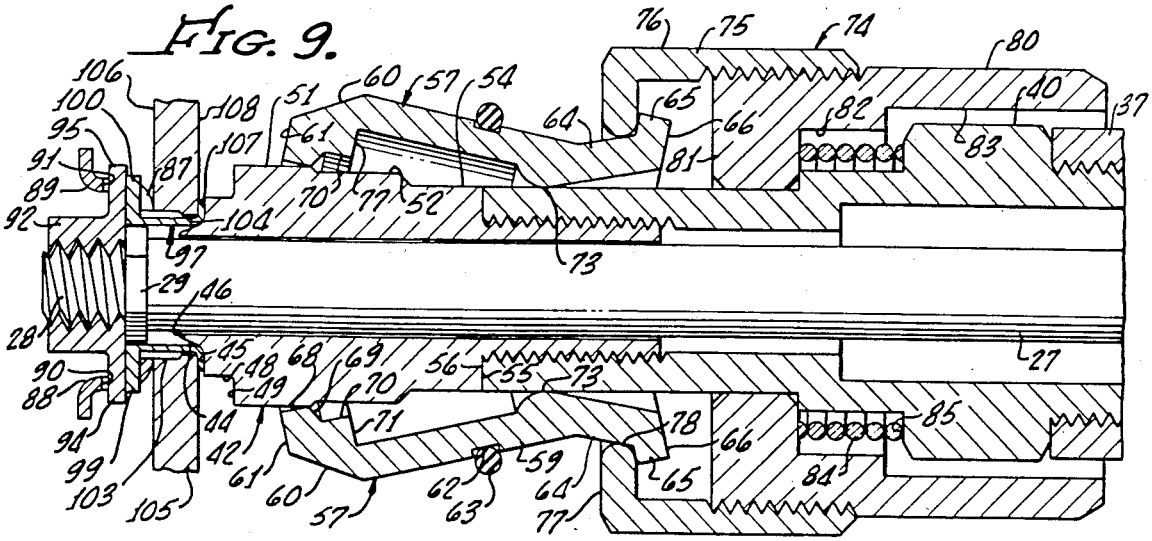
FIG. 9 is a view similar to FIGS. 7 and 8, but with the segmented spacer retracted and the die forming the flange on the end of the workpiece.

The members 57 may be opened and retracted, as shown in FIGS. 3 and 9, by pulling rearwardly on the collar assembly. When this is done, the rounded inner edge of the forward radial end wall 77 of the sleeve 75 slides along the outwardly-flared frustoconical portion 64 of the assembled members 57. This pivots the rearward portions of these members inwardly, rotating them about the fulcrum formed by the curved surfaces 73. As a result, the forward portions of the members 57 are pivoted outwardly, freeing the radial shoulders 71 of the members 57 from the radial shoulder 49 of the die member 42. This allows the members 57 to be moved rearwardly by the collar assembly 74 to the position of FIGS. 3 and 9, with their forward edges bearing against the cylindrical surface 51 of the die member 42. The O-ring 63, exerting an inwardly radial force, keeps the members 57 inwardly against the die member and the forward end of the member 40 where they are held by friction. The spring 84, being a light spring, is of insufficient strength to overcome the frictional resistance to forward movement, even though the spring will advance the collar 80 to the point where its forward radial wall 81 engages the ends of the members 57. This retraction of the members 57 exposes the forward surfaces 44 and 45 of the die member 42.

The tool of this invention is particularly adapted for installation of fasteners of the kind disclosed in U.S. Pat. No. 3,695,324. This type of floating flare nut includes a basket member 87 having opposed side flanges 88 and 89 provided with slots 90 and 91. A nut 92 has a flat base 93 from which extend tabs 94 and 95 that fit within the slots 90 and 91. These tabs are not as wide as the slots 90 and 91, so that the nut is permitted limited lateral floating movement relative to the basket 87. Beneath the nut 92 is a sleeve 97 having a flat head 98 at one end which overlies the central portion of the basket 87. Tabs 99 and 100 project from the head 98 into the slots 90 and 91 beneath the tabs 94 and 95 of the nut 92. The tabs 99 and 100 fit more closely in the slots than the tabs 94 and 95, so that there is little relative lateral movement between the basket and the sleeve.

The outer end portion 102 of the sleeve 97 is relatively thin and bendable. Inwardly of the outer end portion 102 is a straight knurl 103 on the exterior of the sleeve 97.

As the fastener is used, its sleeve 97 extends through an opening 104 in a workpiece, such as a panel 105, with the underside of the basket bearing against one principal flat surface 106 of the workpiece. The straight knurl 103 is forced into the wall of the opening, cutting into the workpiece, so that the knurl prevents rotation of the fastener relative to the workpiece. This means that the nut 92 is held against substantial rotation and can accept a bolt. The thin-walled outer end part 102 of the sleeve 97 must be flared outwardly to form a flange 107 overlying the other principal surface 108 of the workpiece 105 to cooperate with the basket 87 in holding the fastener to the workpiece. This installation is accomplished quite readily by the tool of this invention.

The first step in the installation procedure is to set the position of the die member 42 and pressure pads 57 relative to the rod 27. This is to compensate for the thickness of the workpiece 105 and the length of the sleeve 97 of a particular fastener. This adjustment is accomplished by loosening the set screw 39 and rotating the knob 34 either to advance or retract the member 31. If the member 31 is being retracted, an axial rearward force is applied manually to the assembly that includes the pressure pads 57 and the collar 75, so as to maintain the inner end of the sleeve 37 engaged with the forward end of the member 31. A scale 109 is provided on the outside of the sleeve 37, indicating the distance the forward end of this sleeve protrudes beyond the forward end of the body 10. This, in turn, is an indication of the axial position of die member 42 relative to the rod 27. The knob 34 is rotated until the appropriate figure appears upon the scale 109, after which the set screw 39 is tightened.

Next, the threaded forward end 28 of the rod 27 is extended through the outer end of the sleeve 97 of the fastener and meshed with the threads of the nut 92. The nut 92 is a locking type, out of round at its outer end portion to provide a gripping effect on the bolt it receives when in service. The end 28 of the rod 27 threads into the nut easily without resistance from the locking feature because the threaded end of rod 27 is tapered. The nut is rotated by hand onto the threaded end 28 until the hexagonal portion 29 bears against the undersurface of the base 93 of the nut 92. The flat radial outer ends 60 of the pressure pads 57 then will be adjacent the surface 108 of the workpiece 105. The maximum lateral dimension of the hexagonal portion 29 is only slightly smaller than the interior of the sleeve, so that the hexagonal portion 29 centers the sleeve with respect to the rod 27. The normal lateral floating movement between the nut 92 and sleeve 97 is not then permitted.

After this, the handle 12 is rotated about the pin 13. This moves the slide 20 rearwardly relative to the body 10. In view of their interconnection, this movement of the slide 20 also moves the member 24 and the rod 27 an equal amount to the rear. The body 10 and its associated components are prevented from axial movement because of the engagement of the forward ends 60 of the pressure pads 57 with the surface 108 of the workpiece 105. The interengaged shoulders 71 and 49 of pressure pads 57 and die member 42 provide abutments that prevent the pressure pads from moving axially relative to the body. As a result, the rod 27 pulls on the fastener which forces the fastener sleeve 97 into the opening 104 of the workpiece 105 as the fastener is moved from the position of FIG. 7 to that of FIG. 8. The straight knurl 103 of the fastener sleeve 97 becomes embedded in the wall of the opening 104 as this movement of the fastener occurs. The handle 12 is rotated until there is sufficient movement of the rod 27 to cause the bottom of the basket 87 of the fastener, acting as an abutment, to be brought into engagement with the surface 106 of the panel 105.

The handle 12 is released and the pressure pads 57 then are opened and withdrawn by moving the collar assembly 74 rearwardly, causing the members 57 to pivot and be moved rearwardly as described above. This exposes the surfaces 44 and 45 of the die member 42. The tapered surface 44 at its forward edge 46 has just entered the outer end of the fastener sleeve 97 (but has not engaged it) as a result of the previous movement of the fastener to the FIG. 8 position.

The handle 12 then again is pivoted about the pin 13, creating a reaction on the slide 20 and the body 10. The slide 20, being connected to the rod 27, cannot move rearwardly, because the rod 27 is connected to the fastener nut 92 and the basket 87 of the fastener has been brought into engagement with the surface 106 of the workpiece 105. Consequently, the body 10 is caused to move forwardly. This movement, through the sleeve 37 and the member 40, advances the die member 42 forwardly. The die member then moves from the FIG. 8 to the FIG. 9 position, with the tapered surface 44 flaring the outer end of the portion 102 of the sleeve 97 outwardly, after which it is flattened against the workpiece surface 108 by the radial die surface 45. This produces a flange 107 which completes the installation of the fastener. The tool then is rotated to unthread the rod 27 from the nut 92, and the fastener is ready for service.

Several advantages are realized in the installation of the fastener through the use of the tool of this invention. First of all, the adjustment of the position of the sleeve 26 avoids the use of a multiplicity of separate parts which must be installed when the prior art flaring tool of U.S. Pat. No. 3,665,581 is utilized. Only one puller rod is necessary. The scale 109 on the member 37 facilitates accurate positioning of the components to adjust the tool to the size of fastener and thickness of workpiece encountered.

In addition, the hexagonal portion 29 on the rod 27, centering the sleeve 97 relative to the rod 27, assures that the outer end portion 102 of the sleeve is properly aligned relative to the die surfaces 44 and 45 of the die member 42. This means that a proper flare will be made each time the tool is used and that the die member 42 will not be damaged. In the prior art flaring tool of U.S. Pat. No. 3,665,581, lateral floating was not prevented so that it was possible for the fastener sleeve 97 to be off center relative to the die surface, so that the forward edge 46 of the die could engage the end of the sleeve instead of entering it. The sleeve would not then be flared correctly. Inasmuch as the die comes to a feather edge of the forward corner 46, this could result in damage to the die member as well, requiring its replacement.

The hexagonal portion 29 also bottoms out against the undersurface of the nut to indicate full thread engagement. This accomplishes proper axial positioning of the rod 27 relative to the nut, as well as enough thread engagement to assure that no threads will be stripped during the installation of the fastener.

A major advantage is realized from the segmented pressure pad provided by the members 57 constructed to resemble a collet. Because of this arrangement, the pressure pad members 57 initially extend inwardly in the radial direction almost to the die surface 44. This means that the end surfaces 60 of the pressure pad members 57 bear against the workpiece all around the edge of the opening 104. This provides full support for the workpiece of the opening 104, where the force is applied by the knurl 103 as the fastener sleeve 97 is drawn into the opening. Because of this support, even a relatively thin panel, such as the one illustrated, will not buckle as the fastener sleeve 97 is forced into the opening 104. The earlier tool of U.S. Pat. No. 3,665,581 supported the workpiece at a location well outwardly from the opening and for only a portion of a circle leaving the central portion at the opening unsupported. This lack of support resulted in buckling of the workpiece panels when the workpiece was of relatively small thickness.

After pulling the fastener into the opening, the collet-type pressure pads 57 are very readily and rapidly retracted to expose the die member surfaces 44 and 45, which then are located in precisely the proper position for the flaring operation.

Figure 12:
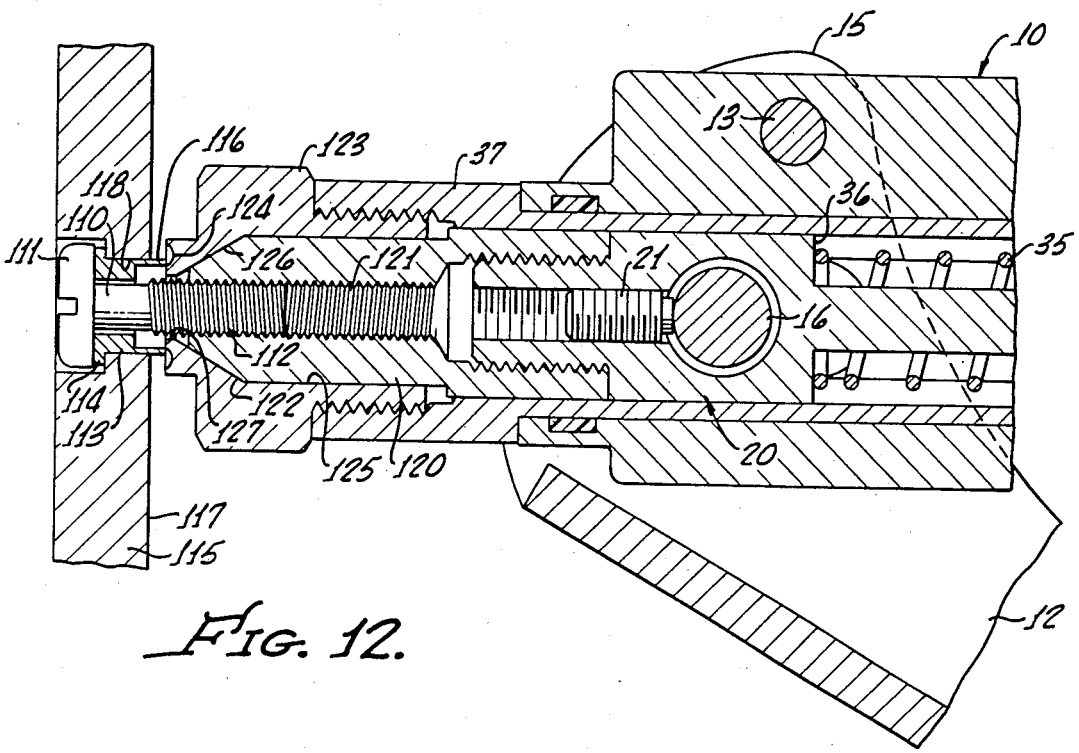
FIG. 12 is a fragmentary longitudinal sectional view of the forward end of the tool, modified for attaching a captive screw to a workpiece.
Figure 13:
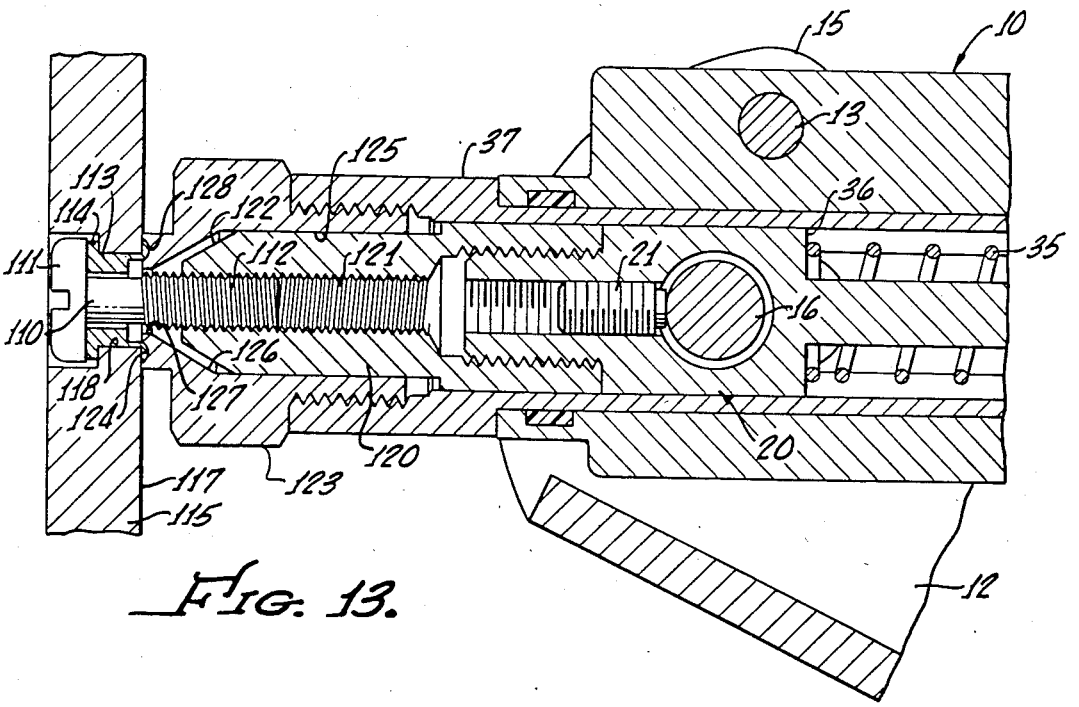
FIG. 13 is a view similar to FIG. 12 with the tool actuated to attach the captive screw.

The tool also may be used for installing captive screws, as illustrated in FIGS. 12 and 13. The captive screw may include a threaded stud 110, with a head 111 at one end and threads 112 at the outer end of the shank. The stud extends through a sleeve 113, which has a head 114 at one end for engaging one side of a workpiece 115. The outer end 116 of the sleeve has a reduced wall thickness and is to be bent over the opposite side 117 of the workpiece when installing the fastener. There is no knurl on the exterior of the sleeve 113, which fits within the opening 118 in the workpiece. Hence, it is not necessary to install the fastener in two stages, as described above, the only operation being that of deflecting the end of the sleeve 116 outwardly to form a flange.

When the tool is used in installing such a captive screw, the members 24, 27, 40 and the die member 42 are removed. Also removed is the segmented spacer 57, the collar assembly 75 and the spring 84. In place of the member 24, the threaded rearward end of a puller 120 is meshed with the threads on the forward end of the slide 20. A threaded bore 121 of smaller diameter extends along the longitudinal axis of the puller 120 to its forward end. Exteriorly, the forward end 122 of the puller 120 is beveled.

A die member 123 has a threaded rearward end which is received in the threaded forward end of the sleeve 37. At the forward end of the die member 123 is an annular groove 124 forming the die surface for bending the end 116 of the fastener sleeve 113 outwardly to form a flange when the tool is actuated.

Internally, the die member includes a cylindrical bore 125 which complementarily receives the exterior of the puller 120. At the forward end of the bore 125 is a bevel 126 complementary to the beveled forward end 121 of the puller 120. An opening 127 extends axially through the forward end of the die member 123 inwardly of the surface 124.

The initial step is to thread the end of the shank 110 of the fastener stud into the threaded bore 121 of the puller 120. These parts are threaded together until the end of the outer sleeve portion 116 is at the radially inner corner of the die surface 124. Then the tool is actuated by pivotally moving the handle 12, which produces a reaction on the body 10 and the slide 20. The slide 20 cannot move rearwardly, because the puller 120 is threaded onto the shank of the stud of the fastener, and, as a result, the body 10 and its associated elements are driven forwardly. This causes the die surface 124 to engage the end 116 of the sleeve 113, deflecting it outwardly along the die surface 124 to form a flange 128, as shown in FIG. 13. This completes the installation of the fastener, and the tool is then separated by unthreading the puller 120 from the shank of the stud.

In installing captive screws, the movement of the body 10 relative to the slide 20 may be limited by the adjusting sleeve 31. A threaded pin 129 fits in the forward end of the sleeve 31 and projects forwardly from it. A pin 130 extends rearwardly from the slide 20. The adjusting sleeve may be set so that the pin 130 and pin 129 will interengage at a predetermined point to limit further movement of the body 10 relative to the slide 20. This can prevent excessive force being exerted in the forming the flange on the end of the sleeve of the fastener.

The foregoing detailed description is to be clearly understood as given by way of illustration and example only, the spirit and scope of this invention being limited solely by the appended claims.

What is claimed is:

1. A tool for attaching to a workpiece a fastener having a gripping portion, a sleeve and a rotation-resisting means comprising a body, a die member carried by said body, said die member having a face having an opening therethrough and an annular die surface around said opening, a movable member carried by said body and movable relative to said body between a position adjacent said die surface and a position remote from said die surface, and having means for extending through said opening in said face of said die member and adapted to extend through an opening in a workpiece for engaging the gripping portion of such a fastener, means for causing said movement of said movable member, and a segmented spacer circumscribing said die member and having a substantially uninterrupted annular surface adjacent said die surface and adapted to engage such a workpiece around said opening therethrough, a portion of said surface of said spacer being radially inward of a portion of said die surface, for supporting said workpiece immediately adjacent said opening and permitting said movable member to force the rotation-resisting means of such a fastener into the opening in such a workpiece without engagement of the sleeve of such a fastener with said die surface, the segments of said segmented spacer being separable and movable to a position remote from said die surface for permitting said die surface subsequently to engage the outer end of the sleeve of such a fastener for flaring said outer end outwardly to form a flange upon subsequent movement of said movable member away from said die surface.

2. A device as recited in claim 1 in which said segmented spacer and said die member include interengageable abutment surfaces for preventing relative movement of said segmented spacer and said die member, said abutment surfaces being disengaged upon said separation of said segments of said segmented spacer.

3. A device as recited in claim 2 in which said abutment surfaces include an internal shoulder on said segmented spacer and an external shoulder on said die member.

4. A device as recited in claim 1 in which said segmented spacer is made up of a plurality of discrete segments.

5. A device as recited in claim 4 including means for biasing said segments against the periphery of said die member axially inwardly of said die surface.

6. A tool for attaching to a workpiece a fastener having a gripping portion, a sleeve and a rotation-resisting means comprising a body, a die member carried by said body, said die member having a face having an opening therethrough and an annular die surface around said opening, a movable member carried by said body and movable relative to said body between a position adjacent said die surface and a position remote from said die surface, and having means for extending through said opening in said face of said die member and adapted to extend through an opening in a workpiece for engaging the gripping portion of such a fastener, means for causing said movement of said movable member, and a segmented spacer circumscribing said die member and having a substantially uninterrupted annular surface adjacent said die surface and adapted to engage such a workpiece around said opening therethrough for supporting said workpiece and permitting said movable member to force the rotation-resisting means of such a fastener into said opening in said workpiece without engagement of the sleeve of such a fastener with said die surface, the segments of said segmented spacer being separable and movable to a position remote from said die surface for permitting said die surface subsequently to engage the outer end of the sleeve of such a fastener for flaring said outer end outwardly to form a flange upon subsequent movement of said movable member away from said die surface, said segments of said segmented spacer including fulcurm portions engaging the exterior of said body, said segments being pivotal about said fulcrum portions for thereby separating said segments for movement to a position remote from said die surface.

7. A device as recited in claim 6 in which said segments of said segmented spacer have portions inclining outwardly away from said fulcrum portions, and including means movable relative to said body for engaging said inclined portions and forcing them inwardly for thereby causing said segments to so pivot about said fulcrum portions for so separating said segments.

8. A device as recited in claim 7 in which said means movable relative to said body for engaging said inclined portions comprises a collar having a forward flange engageable with said inclined portions upon rearward movement of said collar relative to said die surface, and resilient means biasing said collar forwardly.

9. A tool for attaching to a workpiece a fastener having a gripping portion, a sleeve and a rotation-resisting means comprising a body, a die member carried by said body, said die member having a face having an opening therethrough and an annular die surface around said opening, a movable member carried by said body and movable relative to said body between a position adjacent said die surface and a position remote from said die surface, and having means for extending through said opening in said face of said die member and adapted to extend through an opening in a workpiece for engaging the gripping portion of such a fastener, means for causing said movement of said movable member, and a segmented spacer circumscribing said die member and having a substantially uninterrupted annular surface adjacent said die surface and adapted to engage such a workpiece around said opening therethrough for supporting said workpiece and permitting said movable member to force the rotation-resisting means of such a fastener into the opening in such a workpiece without engagement of the sleeve of such a fastener with said die surface, the segments of said segmented spacer being separable radially and movable axially to a position remote from said die surface for permitting said die surface subsequently to engage the outer end of the sleeve of such a fastener for flaring said outer end outwardly to form a flange upon subsequent movement of said movable member away from said die surface.

10. A device as recited in claim 9 in which said means for extending through said opening in said face of said die member and said opening in said workpiece comprises a rod having external threads on the outer end thereof.

11. A device as recited in claim 9 including adjustable means for adjusting the position of said body relative to said movable member for thereby adjusting the position of said die member relative to said workpiece.

12. For use with a fastener having a nut, a sleeve, said nut being capable of limited lateral floating movement relative to said sleeve, and rotationresisting means on said sleeve, a tool for forcing the rotation-resisting means of such a fastener into an opening in such a workpiece, and for bending the outer end of the sleeve of such a fastener for forming a flange comprising a body, a die member carried by said body, said die member having a face having an opening therethrough and an annular die surface around said opening, a movable member carried by said body and movable relative to said body between a position adjacent said die surface and a position remote from said die surface, and having a rod for extending through said opening in said face of said die member and adapted to extend through an opening in such a workpiece for engaging the nut of such a fastener, said rod having external threads on the outer end thereof meshable with the threads of said nut, said rod having means thereon adapted to be closely received in the sleeve of such a fastener when said threads of said rod so mesh with said threads of said nut for precluding substantial floating movement of said nut relative to said sleeve, thereby to center said sleeve relative to said die surface, said movable member including a threaded opening, said rod including threads at its inner end meshed with said threads of said movable member, and including wrenching surfaces outwardly of said die member for permitting rotation of said rod disengagement from said movable member, means for causing said movement of said movable member, and a segmented spacer circumscribing said die member and having a substantially uninterrupted annular surface adjacent said die surface and adapted to engage such a workpiece around such an opening therethrough for supporting said workpiece and permitting said movable member to force said rotation-resisting means into such an opening in such a workpiece without engagement of said sleeve with said die surface, the segments of said segmented spacer being separable and movable to a position remote from said die surface for permitting said die surface subsequently to engage said outer end of said sleeve for flaring said outer end outwardly to form a flange upon subsequent movement of said movable member away from said die surface.

13. A device as recited in claim 12 in which said means on said rod closely receivable in such a sleeve is a hexagonal section providing said wrenching surfaces.

14. A tool for attaching to a workpiece a fastener having a gripping portion, a sleeve and a rotation-resisting means comprising a body, a die member carried by said body, said die member having a face having an opening therethrough and an annular die surface around said opening, a movable member carried by said body and movable relative to said body between a position adjacent said die surface and a position remote from said die surface, and having means for extending through said opening in said face of said die member and adapted to extend through an opening in a workpiece for engaging the gripping portion of such a fastener, means for causing said movement of said movable member, and a segmented spacer circumscribing said die member and having a substantially uninterrupted annular surface adjacent said die surface and adapted to engage such a workpiece around said opening therethrough for supporting said workpiece and permitting said movable member to force the rotation-resisting means of such a fastener into said opening in said workpiece without engagement of the sleeve of such a fastener with said die surface, the segments of said segmented spacer being separable and movable to a position remote from said die surface for permitting said die surface subsequently to engage said outer end of the sleeve of such a fastener for flaring said outer end outwardly to form a flange upon subsequent movement of said movable member away from said die surface, said body including a first portion and a second portion, said second portion being movable relative to said first portion, said second portion carrying said die member, and including adjustable means for adjusting the position of said second portion relative to said first portion.

15. A device as recited in claim 14 in which said second portion of said body is slidably received in said first portion thereof, said adjustable means including a member threadably engaging said first portion and engageable with said second portion for positioning said second portion relative to said first portion upon rotation of said last-mentioned member.

16. A device as recited in claim 15 including, in addition, indicia on said second portion of said body for providing a visual indication of the relative positions of said first and said second portions of said body.

17. A device as recited in claim 16 including, in addition, releasable means for locking the position of said second body portion relative to said first body portion.

18. A tool for attaching to a workpiece a fastener having a gripping portion, a sleeve and a rotation-resisting means comprising a body, a die member carried by said body, said die member having a face having an opening therethrough and an annular die surface around said opening, a movable member carried by said body and movable relative to said body between a position adjacent said die surface and a position remote from said die surface, and having means for extending through said opening in said face of said die member and adapted to extend through an opening in a workpiece for engaging the gripping portion of such a fastener, means for causing said movement of said movable member, a segmented spacer made up of a plurality of discrete segments circumscribing said die member and having a substantially uninterrupted annular surface adjacent said die surface and adapted to engage such a workpiece around said opening therethrough for supporting said workpiece and permitting said movable member to force the rotation-resisting means of such a fastener into said opening in said workpiece without engagement of the sleeve of such a fastener with said die surface, the segments of said segmented spacer being separable and movable to a position remote from said die surface for permitting said die surface subsequently to engage the outer end of the sleeve of such a fastener for flaring said outer end outwardly to form a flange upon subsequent movement of said movable member away from said die surface, and an elasatomeric O-ring circumscribing said segments for biasing said segments against the periphery of said die member axially inwardly of said die surface.

19. A tool for attaching to a workpiece a fastener having a gripping portion, a sleeve and a rotation-resisting means comprising a body, a die member carried by said body, said die member having a face having an opening therethrough and an annular die surface around said opening, a movable member carried by said body and movable relative to said body between a position adjacent said die surface and a position remote from said die surface, and having means for extending through said opening in said face of said die member and adapted to extend through an opening in a workpiece for engaging the gripping portion of such a fastener, means for causing said movement of said movable member, and a segmented spacer circumscribing said die member and having a substantially uninterrupted annular surface adjacent said die surface and adapted to engage such a workpiece around said opening therethrough for supporting said workpiece and permitting said movable member to force the rotation-resisting means of such a fastener into said opening in said workpiece without engagement of the sleeve of such a fastener with said die surface, the segments of said segmented spacer being separable and movable to a position remote from said die surface for permitting said die surface subsequently to engage said outer end of the sleeve of such a fastener for flaring said outer end outwardly to form a flange upon subsequent movement of said movable member away from said die surface, said body including an inner portion and an outer portion, said movable member being slidable in said inner portion, and said means for causing said movement of said movable member including a member pivotally connected to said outer portion and engaging said movable member for moving said movable member when pivoted relative to said outer portion.

20. For use with a fastener having a nut, a sleeve, said nut being capable of limited lateral floating movement relative to said sleeve, and rotationresisting means on said sleeve, a tool for forcing the rotation-resisting means of such a fastener into an opening in a workpiece and for bending the outer end of the sleeve of such a fastener for forming a flange comprising a body, a die member carried by said body, said die member having a face having an opening therethrough and an annular die surface around said opening, a movable member carried by said body and movable relative to said body between a position adjacent said die surface and a position remote from said die surface, and having a rod for extending through said opening in said face of said die member and adapted to extend through an opening in such a workpiece for engaging the nut of such a fastener, said rod having external threads on the outer end thereof meshable with the threads of said nut, said rod having means thereon adapted to be closely received in the sleeve of such a fastener when said threads of said rod so mesh with said threads of said nut for precluding substantial floating movement of said nut relative to said sleeve, thereby to center said sleeve relative to said die surface, means for causing said movement of said movable member, and a segmented spacer circumscribing said die member and having a substantially uninterrupted annular surface adjacent said die surface and adapted to engage such a workpiece around such an opening therethrough for supporting said workpiece and permitting said movable member to force said rotation-resisting means into such an opening in such a workpiece without engagement of said sleeve with said die surface, the segments of said segmented spacer being separable and movable to a position remote from said die surface for permitting said die surface subsequently to engage said outer end of said sleeve for flaring said outer end outwardly to form a flange upon subsequent movement of said movable member away from said die surface.

* * * * *